US007152427B2

(12) United States Patent
Haussmann

(10) Patent No.: US 7,152,427 B2
(45) Date of Patent: Dec. 26, 2006

(54) ACCUMULATOR WITH AN INTERNAL HEAT EXCHANGER FOR AN AIR-CONDITIONING SYSTEM

(75) Inventor: Roland Haussmann, Wiesloch (DE)

(73) Assignee: Valeo Klimasysteme GmbH, Rodach (DE)

( * ) Notice: Subject to any disclaimer, the term of this patent is extended or adjusted under 35 U.S.C. 154(b) by 0 days.

(21) Appl. No.: 11/247,802

(22) Filed: Oct. 11, 2005

(65) Prior Publication Data

US 2006/0080997 A1 Apr. 20, 2006

(30) Foreign Application Priority Data

Oct. 15, 2004 (DE) ..... 10 2004 050 409

(51) Int. Cl.
*F25B 47/00* (2006.01)

(52) U.S. Cl. ..... 62/503; 62/471

(58) Field of Classification Search ..... 62/503, 62/513, 471

See application file for complete search history.

(56) References Cited

U.S. PATENT DOCUMENTS 6,463,757 B1 * 10/2002 Dickson et al. ..... 62/503
6,612,128 B1 * 9/2003 Dickson et al. ..... 62/471

* cited by examiner

*Primary Examiner*—Melvin Jones
(74) *Attorney, Agent, or Firm*—Ronald Courtney

(57) ABSTRACT

An accumulator for an air conditioning system, including a housing (10) with an elongated tubular wall (12). The accumulator also includes an internal heat exchanger fitted in the housing (10). The internal heat exchanger has a tubular structure (40) with radially protruding ribs (40, 42) arranged coaxially with the housing wall (12).

20 Claims, 6 Drawing Sheets

Figure 1:
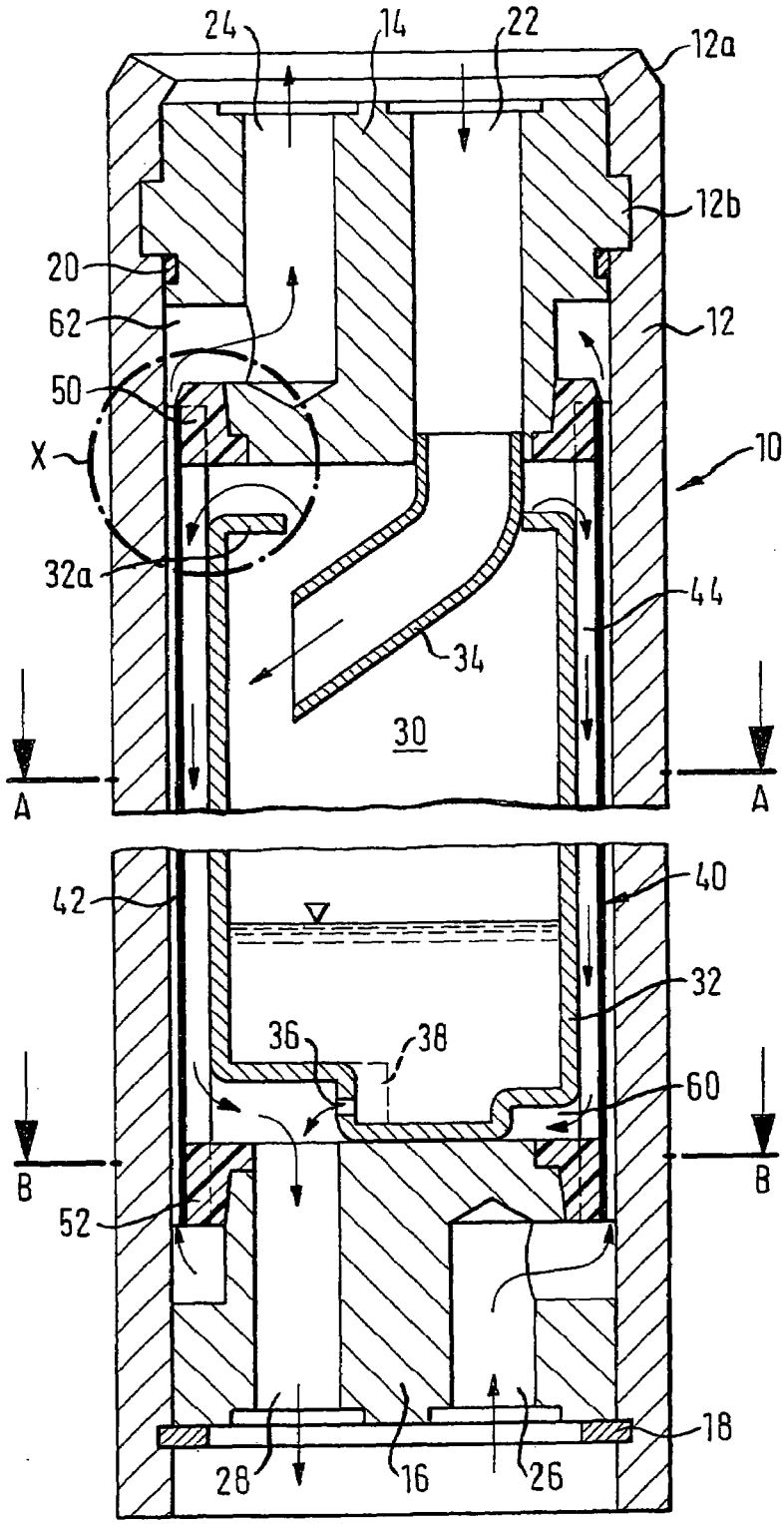

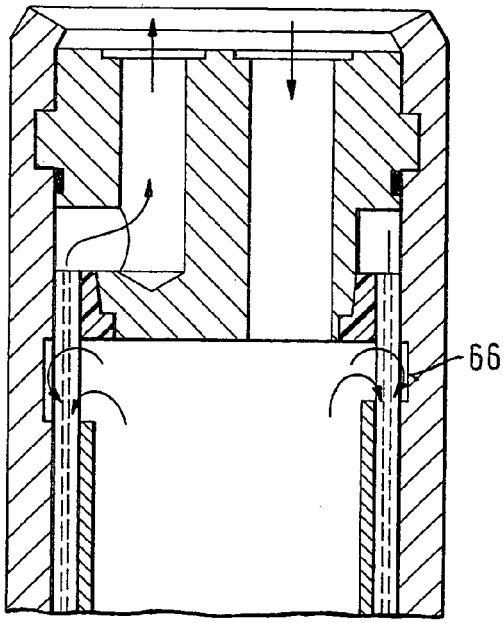
FIG. 8
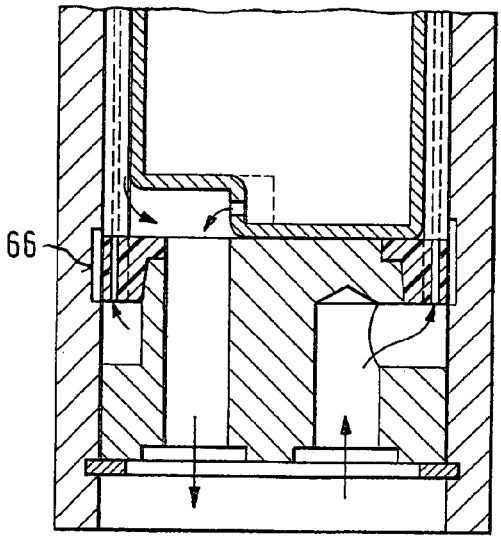
FIG. 9
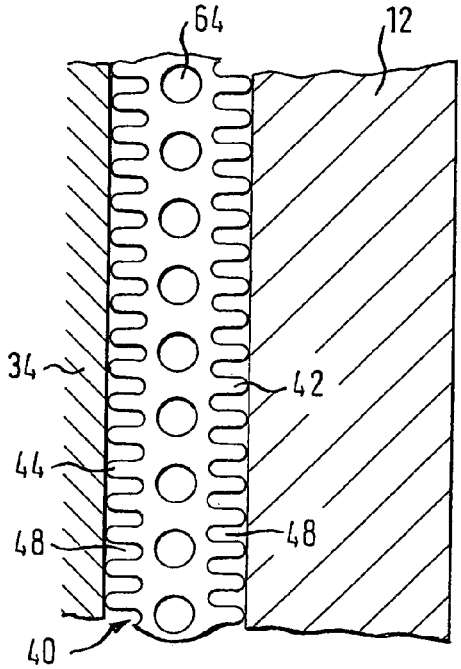

ACCUMULATOR WITH AN INTERNAL HEAT EXCHANGER FOR AN AIR-CONDITIONING SYSTEM

The invention relates to an accumulator for an air-conditioning system, specifically for use in motor vehicles, comprising a housing with an elongated tubular wall and an internal heat exchanger built into the housing. More specifically, the invention relates to an accumulator for an air-conditioning system with a coolant circulation that can run supercritically, e.g. a $CO_2$ vehicle air-conditioning system. As well as an accumulator, such a coolant circulation normally comprises a condenser, a liquefier, and expansion device, an internal heat exchanger and an evaporator.

The integration of an internal heat exchanger into an accumulator is a known technique, for example in U.S. Pat. No. 6,523,365 B2, which demonstrates this type of accumulator. The internal heat exchanger in this case essentially comprises a double spiral tube within the accumulator housing, through which both the high and low pressure coolant flows are passed in opposite directions. The disadvantage of this construction is above all that the heat exchanger requires a lot of room in the accumulator.

The invention provides an accumulator with an internal heat exchanger that can be manufactured cheaply, does not need much space to be built in, but nevertheless provides enough surface area for heat exchange in the coolant.

According to the invention, this type of accumulator is envisaged to have an internal heat exchanger comprising a tubular structure with radially protruding ribs aligned coaxially with the wall of the housing. These ribs define a multitude of high-pressure or low-pressure lines, through which the coolant flows. The construction according to the invention allows the heat exchanger structure to be supported by the housing, so that the strength of the walls of this structure can be minimised. The heat exchanger structure, and specifically its profile, only has to meet the requirements for heat conduction and transfer. This means that the walls do not have to be very strong, despite the high operating pressures; a larger surface area for the heat exchanging structure can then be made from the same amount of material. The heat exchanger structure according to the invention can be manufactured cheaply by extrusion techniques. Since the structure of the heat exchanger according to this invention does not need closed channels for the high pressure and/or low pressure lines—only the radially protruding ribs—this simplifies the manufacturing process considerably, and no cores are needed. The heat exchanger structure is a separate component that can be placed in the accumulator simply and very ergonomically (it is like a second wall). No changes are required to the exterior housing of the accumulator, i.e. the exterior housing can be manufactured as a simple tube by a reliable process, and it will be stable under pressure.

Arranging the heat exchanger structure between the housing wall and a liquid container within the housing is particularly advantageous.

The heat exchanger structure should preferably comprise both inward-pointing and outward-pointing radial ribs, so that lines for the coolant on the high pressure side are formed on one side and for the low-pressure side on the other.

The formation of flow lines enclosed in the cross-section can then easily be carried out, since the ribs are next to the housing wall and the liquid container respectively.

Figure 2:
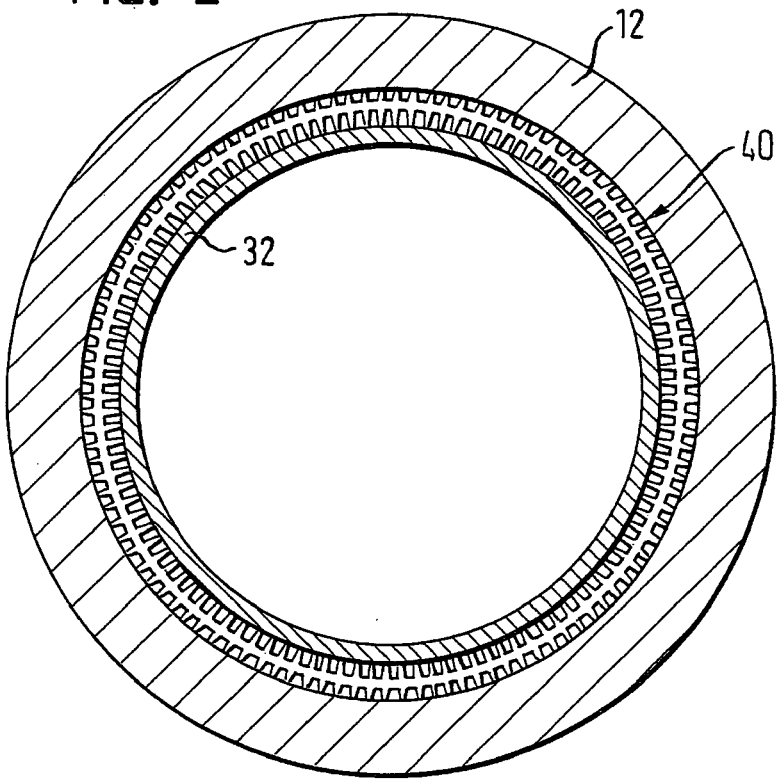
Figure 3:
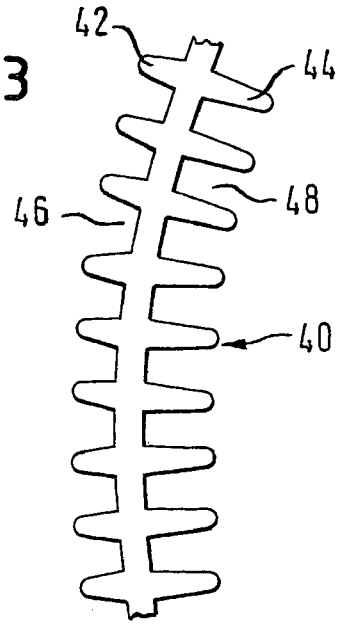
Figure 4:
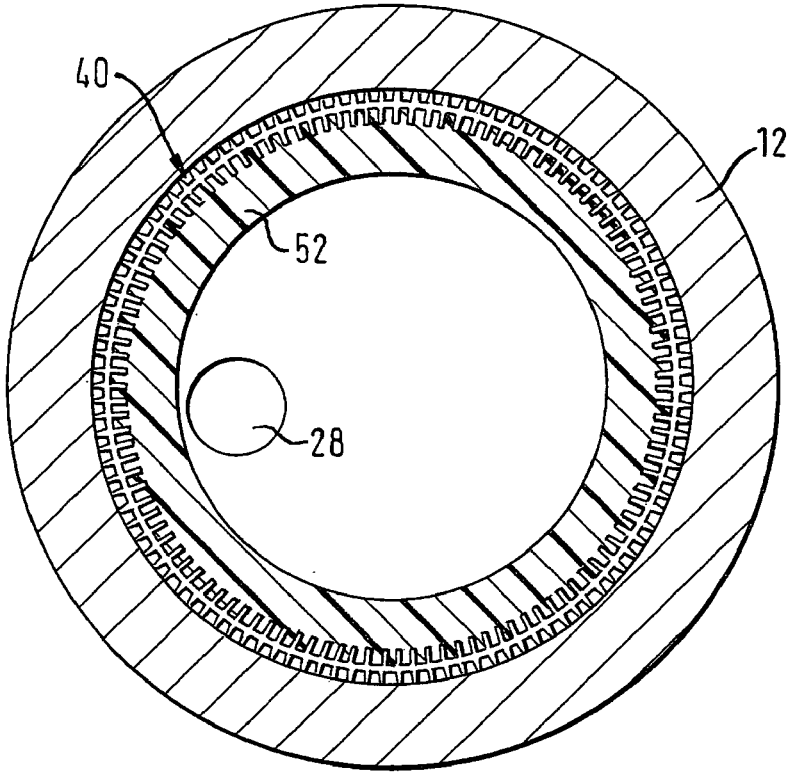
Figure 5:
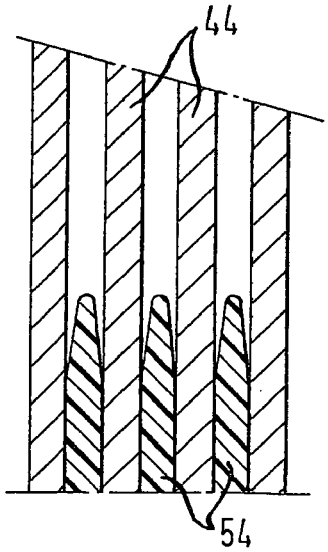
Figure 6:
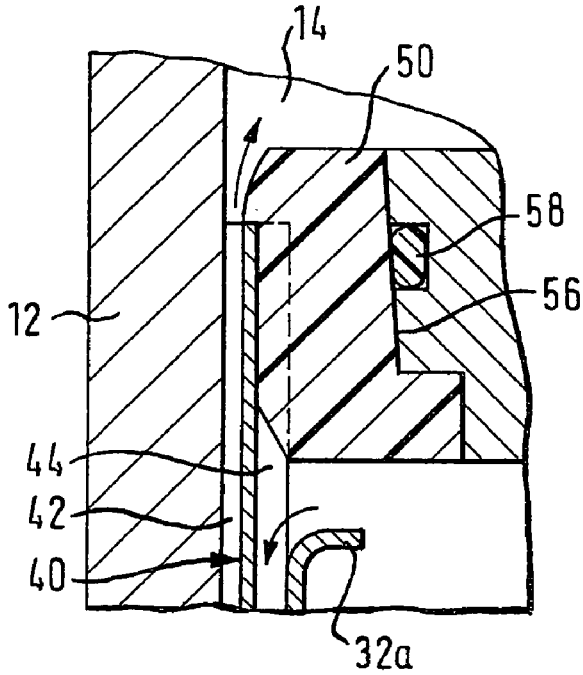
Figure 7:
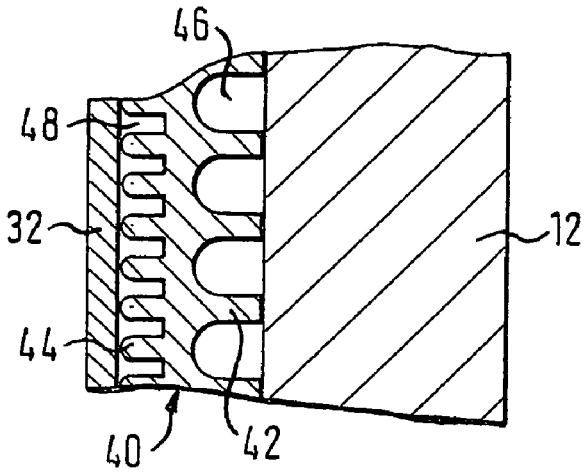
Figure 10:
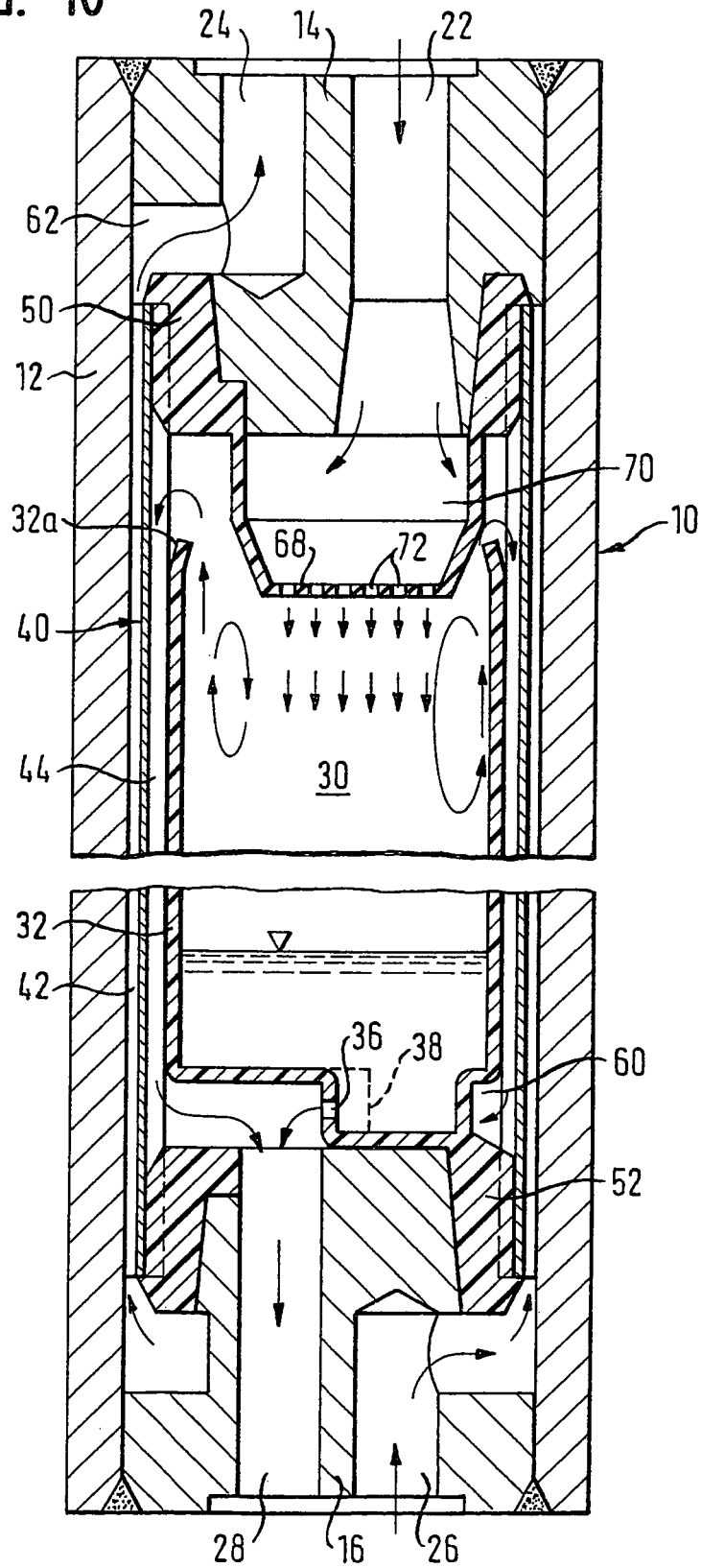

Further characteristics and benefits of the invention can be seen from the preferred embodiments described below and with reference to the attached figures. The figures show:

FIG. 1: a longitudinal section of an accumulator according to the invention, according to a first embodiment;

FIG. 2: a cross-section along the line A—A in FIG. 1;

FIG. 3: a detailed enlargement of the cross-section of the heat exchanger structure in FIG. 2;

FIG. 4: a cross-section along the line B—B in FIG. 1;

FIG. 5: a detailed enlargement of the cross-section of the heat exchanger structure and the seal from FIG. 4;

FIG. 6: an enlargement of detail X in FIG. 1;

FIG. 7: a detailed enlargement of the cross-section of a heat exchanger structure according to a first alternative embodiment;

FIG. 8: a simplified view corresponding to FIG. 1 for an accumulator according to the invention, according to a second alternative embodiment of the heat exchanger structure;

FIG. 9: a detailed enlargement of the cross-section of the heat exchanger structure according to the second alternative embodiment; and FIG. 10: a longitudinal section of an accumulator according to the invention, according to a second embodiment.

FIG. 1 represents a first embodiment of an accumulator according to this invention. The accumulator has an aluminium housing 10 with an elongated tubular wall 12 that is 4 to 6 mm thick. The housing 10 is closed off at its axial ends by an upper and lower end piece 14, 16 respectively. The end pieces 14, 16 are held in place by a combination of crimping one edge of the housing wall 12*a* and a tight fit, e.g. using a collar 12*b* (see the upper end piece, 14), or by a circlip 18 (see the lower end piece, 16) fitted into a recess in the housing. If necessary, an additional seal 20 can ensure a tight connection. The upper end piece 14 comprises a low-pressure inlet 22 and a high-pressure outlet 24; the lower end piece 16 comprises a high-pressure inlet 26 and a low-pressure outlet 28.

Between the two end pieces 14, 16, a liquid container 30 has been placed to hold the liquid coolant. A tubular element 34 that is connected to the low-pressure inlet and points towards the wall 32 of the liquid container 30 juts through the open upper end of the liquid container 30 and projects inside it. At the lower end of the liquid container 30, there is an outlet aperture 36 with a filter 38 in front of it, which is connected to the low-pressure outlet 28 so that small quantities of coolant and lubricant can exit through it. This avoids having oil accumulate in the liquid container 30.

Between the tubular housing wall 12 and the wall 32 of the liquid container 30 there is a tubular aluminium heat exchanger structure 40 with longitudinal radial ribs 42, 44. The cross-sectional shape of these ribs can be seen in FIG. 2, and in detail in FIG. 3. The heat exchanger structure 40 is supported by the interior face of the housing wall 12 on its outward-facing radial ribs 42, thereby forming a multitude of axial high pressure lines 46. The inward-facing radial ribs 44 are positioned on the outside of the wall 32 of the liquid container 30 and thereby define a large number of axial low-pressure lines 48. In total, the heat exchanger structure 40 with its protruding ribs 42, 44 extends in the axial direction from the upper end piece 14 to the lower end piece 16.

The heat exchanger structure 40 is connected to the end pieces (14, 16) by elastic, deformable plastic seals 50, 52, which seal off the low pressure side from the high pressure side. As is shown in FIG. 4 and in more detail in FIG. 5, the seals 50, 52 have a number of conical protrusions 54, corresponding in number to the interstitial spaces between the inward-facing ribs 44 of the heat exchanger structure 40.

These are pressed into said interstitial spaces. Alternatively, an airtight connection between the seals 50, 52 and the heat exchanger structure 4 can also be created by friction welding, which generally gives a better tolerance. It is also possible to melt the seals 50, 52—in this case without the protrusions 54—onto the outer edge and then press them between the ribs 44 of the heat exchanger structure 40. Finally, the heat exchanger structure 40 can also be directly involved in the injection moulding process of the seals 50, 52. In any event, the heat exchanger structure 40 and the seals 50, 52 can form a pre-assembled component.

The airtight connection of the seals 50, 52 with the end pieces 14, 16 shown in detail in FIG. 6 is formed by pressing the seals 50, 52 onto the end pieces 14, 16. The connection can also be manufactured or supported by a slanting protrusion of a side wall 56 of the end pieces 14, 16 and/or by an additional flexible ring seal 58.

In the following paragraphs, the operational principle of the accumulator in a typical coolant circuit for an air-conditioning system is described. The coolant mostly comes out of the evaporator in vapour form, under low pressure (this is hereinafter referred to as low-pressure coolant). It is then passed via the low-pressure inlet 22 in the upper end piece 14 into the accumulator. The low-pressure coolant reaches the inside of the liquid container 30 via the tubular element 34. The tubular element 34 directs the low-pressure coolant tangentially onto the wall 32 of the liquid container 30, so that the liquid portion of the low-pressure coolant is deposited on the wall 32 and flows down into the lower collection area of the liquid container 30. The gaseous portion of the low-pressure coolant, now separated from the liquid portion, rises upwards and goes past the top edge 32*a* of the liquid container 30, into the low-pressure lines 48, which are defined by the inward-pointing radial ribs 44 of the heat exchanger structure 40 and the exterior of the wall 32 of the liquid container 30. The low-pressure coolant flows downwards into the first ring-shaped collection channel 60. This first collection channel is connected to the low-pressure outlet 28, through which the low-pressure coolant leaves the accumulator.

At the same time, coolant under high pressure coming from the coolant circuit's condenser (hereinafter referred to as high-pressure coolant) enters the accumulator from below, via the high-pressure inlet 26. The high-pressure coolant goes into the high-pressure lines 46, which are defined by the outward-facing radial ribs 42 and the interior side of the housing wall 12. The high-pressure coolant therefore flows upwards, in the opposite direction to the low-pressure coolant, on the other side of the heat exchanger structure 40. The large effective surfaces of the low-pressure and high-pressure lines 46, 48 ensure that an efficient exchange of heat between the high-pressure coolant and the low-pressure coolant takes place. The high-pressure coolant is collected in a second ring-shaped collection channel 62 and leaves the accumulator via the high-pressure outlet 24, which is connected to the second collection channel 62.

Varying the numbers, the widths (in the radial direction) and the thickness (along the circumference) of the ribs 42, 44 of the heat exchanger structure 40 makes it possible to design the low-pressure and high-pressure lines 46, 48 to suit particular requirements. In particular, this allows the optimum ratio between the effective heat exchange surfaces in the heat exchanger structure 40 to be produced, on the low-pressure side and the high-pressure side. An example of a cross-sectional shape of the heat exchanger structure 40 that differs from the one in FIG. 3 is shown in FIG. 7.

Another alternative embodiment with respect to the cross-sectional design of the heat exchanger structure 4 is given in FIGS. 8 and 9. These have both the inward-facing and outward-facing protruding radial ribs 42, 44 defining the lines 48 for the low-pressure coolant. The high-pressure coolant is in this case passed through separated channels 64 formed in the central part of the heat exchanger structure 40 (see FIG. 9). In order to allow the low-pressure coolant to enter the outer low-pressure lines 48 as well, these alternative embodiments comprise inlet chambers 66 in the housing wall 12 at the points where they meet the end pieces 14, 16 (see FIG. 8).

FIG. 10 shows a second embodiment of for an accumulator according to this invention. The components that correspond to those in the first alternative embodiment and have the same function have been indicated with the same references, despite any possible differences in the concrete form of said components, and they will not be described further.

The end pieces 14, 16 that close off the housing 10 are in this case welded onto the housing 10. The diameter of the low-pressure inlet 22 increases as it goes downward, thereby acting as a diffuser. Instead of the tubular element 34, a structure (68) is envisaged consisting of a single piece together with the upper seal 50, forming an expansion antechamber 70 with exit holes 72. The diffuser and the expansion antechamber ensure that the incoming low-pressure coolant is slowed down. The arrangement and the diameter of the individual exit holes 72 are adjusted with respect to regions with and without dynamic pressure in such a way that a homogenous exit flow with a steady flow velocity is guaranteed across the entire floor area of the expansion antechamber 70 into the liquid container 30. In this embodiment, the liquid container 30 consists of a single piece together with the lower seal 52. Otherwise, the operating principle of this embodiment is the same as that for the first embodiment described.

It is naturally possible to apply certain features of one embodiment or alternative embodiment to another embodiment or alternative embodiment.

All the embodiments and alternative embodiments described are characterised in that a stable and easily produced tube with a wall up to 6 mm thick can be used as the housing 10, so that the heat exchanger structure 40 stabilised by the housing wall 12 can be made with a lower wall strength. This cost-effective design enables a very large heat exchange surface to be made in a small volume and at a low weight, which is a major advantage for a supercritical $CO_2$ coolant circuit at high pressures (operating pressure on the high pressure side up to 140 bar; the pressure on the low-pressure side when the air-conditioning unit is switched off is up to 100 bar).

The invention claimed is:

1. An accumulator for an air conditioning system, having:

1) a housing (10) comprising an elongated tubular wall (12);

2) a heat exchanger internal to the elongated tubular wall of the housing; and 3) a liquid container internal to the heat exchanger, wherein the heat exchanger has a tubular heat exchange structure (40) with radially protruding ribs (44, 42) arranged coaxially with the elongated tubular housing wall (12).

2. An accumulator according to claim 1, wherein the heat exchanger structure (40) comprises radial ribs pointing both inwards (42) and outwards.

3. An accumulator according to claim 2, wherein the heat exchanger structure (40) is supported by the housing.

4. An accumulator according to claim 3, wherein the housing of accumulator has two axial ends, and wherein ribs (42, 44) adjoin the elongated housing wall (12) and the liquid container (30) respectively.

5. An accumulator according to claim 1, further comprising a low-pressure inlet, wherein the radially protruding ribs are inward-pointing, wherein interstitial spaces are formed between the inward-pointing radial ribs (44), and wherein the interstitial spaces are connected to the low-pressure inlet (22) of the accumulator.

6. An accumulator according to claim 5, further comprising outward-pointing radial ribs and interstitial spaces between the outward-pointing radial ribs (42), wherein the interstitial spaces between the outward-pointing radial ribs are connected to the low-pressure inlet (22).

7. An accumulator according to claims 2, wherein interstitial spaces exist between the outward-pointing radial ribs (42) and are connected to a high-pressure inlet (26) of the accumulator.

8. An accumulator according to claim 1, further comprising channels (64) in a central region of the heat exchanger structure (40).

9. An accumulator according to claim 4, further comprising end pieces (14, 16) connected to the heat exchange structure, and seals (50, 52) fitted to ends of the heat exchanger structure (40), wherein the ends of the heat exchange structure are axial ends, and wherein the heat exchanger structure (40) and the seals (50, 52) form a pre-assembled component.

10. An accumulator according to claim 9, wherein the seals (50, 52) are connected to the end pieces (14, 16) so that they close off the axial ends of the housing (10).

11. An accumulator according to claim 10, further comprising a low-pressure inlet (22) and a high-pressure outlet (24) in one end piece (14), and a high-pressure inlet (26) and a low-pressure outlet (28) in the other end piece (16).

12. An accumulator according to claim 1, wherein the heat exchanger structure is built into the housing.

13. An accumulator according to claim 2, wherein the housing and the heat exchanger are aluminum.

14. An accumulator according to claim 1, wherein the radial ribs are longitudinal radial ribs.

15. An accumulator according to claim 2, wherein the radial ribs are longitudinal radial ribs.

16. An accumulator according to claim 3, wherein the radial ribs are longitudinal radial ribs.

17. An accumulator according to claim 8, wherein the radial ribs are longitudinal radial ribs.

18. An accumulator according to claim 9, wherein the radial ribs are longitudinal radial ribs.

19. An accumulator according to claim 11, wherein the radial ribs are longitudinal radial ribs.

20. An accumulator according to claim 2, wherein the radial ribs are heat conduction and transfer ribs.

* * * * *